US007644677B2

(12) United States Patent
Nakano

(10) Patent No.: US 7,644,677 B2
(45) Date of Patent: Jan. 12, 2010

(54) MARINE SAFETY LADDER

(75) Inventor: Yukinari Nakano, Hiroshima (JP)

(73) Assignee: Marine Works Co., Ltd., Hiroshima (JP)

( * ) Notice: Subject to any disclaimer, the term of this patent is extended or adjusted under 35 U.S.C. 154(b) by 576 days.

(21) Appl. No.: 11/529,933

(22) Filed: Sep. 29, 2006

(65) Prior Publication Data

US 2007/0113773 A1 May 24, 2007

(30) Foreign Application Priority Data

Oct. 3, 2005 (JP) ..... 2005-008110

(51) Int. Cl.
*B63B 17/00* (2006.01)

(52) U.S. Cl. ..... 114/362; 182/88

(58) Field of Classification Search ..... 114/362; 182/86, 88, 91, 92, 95, 97, 127
See application file for complete search history.

(56) References Cited

U.S. PATENT DOCUMENTS

| | | | | |
|---|---|---|---|---|
| 4,860,854 | A * | 8/1989 | Lodholz, Jr. | 182/88 |
| 4,907,673 | A * | 3/1990 | Ginter et al. | 114/362 |
| 5,228,707 | A * | 7/1993 | Yoder | 182/88 |
| 5,697,470 | A * | 12/1997 | Carle | 182/88 |
| 6,345,691 | B1 * | 2/2002 | Ruiz | 182/88 |
| 6,904,863 | B2 * | 6/2005 | Mardikian et al. | 114/362 |
| 6,948,588 | B1 * | 9/2005 | Chustak | 182/97 |
| 7,025,174 | B1 * | 4/2006 | Hawley | 182/88 |
| 7,182,175 | B1 * | 2/2007 | Schmitt et al. | 182/88 |

FOREIGN PATENT DOCUMENTS

| | | |
|---|---|---|
| JP | 7-24697 | 5/1995 |
| JP | 2000-144633 | 5/2000 |

* cited by examiner

*Primary Examiner*—Lars A Olson
(74) *Attorney, Agent, or Firm*—William L. Androlia; H. Henry Koda

(57) ABSTRACT

To provide a marine safety ladder that makes rescue possible within a short time, without posing any risk of contact with a pleasure boat or the like, without causing any additional concern in the operation of boats during docking and departure, without the risk of injury to a person who has fallen, etc., and without the risk of falling when the ladder is being stowed.

A top hinge member (67) is connected and fixed to one end, a middle hinge member (68) is connected and fixed to the middle, and a bottom hinge member (69) is connected and fixed to the other end, respectively, to, in the width direction, the underside of a deck (2) of a floating pier (1) or of a transom step (2') of a boat (1'); and a main ladder (20) and guide rails (30) are provided rotatable about the top hinge member (67) via top connecting members (61); and with a bottom latch element (64) being engaged with the bottom end of the main ladder (20) or members in the vicinity thereof, a sliding member (40) is located at the bottom end of the guide rails (30), and all constituting parts are stowed within the width of the deck (2) of the floating pier (1).

2 Claims, 8 Drawing Sheets

MARINE SAFETY LADDER

FIELD OF TECHNOLOGY

The present utility model relates to a safety ladder that is provided to a floating pier used for pleasure boats and the like and installed in a marina or the like or that is provided to a pleasure boat.

BACKGROUND ART

A person waling on the deck of a floating pier installed in a marina or the like and used for pleasure boats and so forth, or people on board a pleasure boat or the like that is moored or preparing to dock or depart, sometimes accidentally fall into water. The marine safety ladders that reach from the deck to the water are provided along the floating pier in case such accidents should happen. The person who has fallen into the water or a rescuer who has gone into the water to help the fallen person makes his or her way to the safety ladder, climbs the safety ladder, and comes out of the water onto the deck of the floating pier. Similar accidents would occur on pleasure boats when people fall off the transom step.

A rescue apparatus that is used with boats and floating piers and includes such a safety ladder as described above is disclosed in Japanese Patent Application Laid-Open (Kokai) No. 2000-144633. The floating pier-use rescue apparatus disclosed in this publication comprises a safety ladder and a fender member. The safety ladder is provided at a location a specific distance away from a cleat attachment location where a pleasure boat or the like is to be moored, and the fender member is provided to the periphery of the safety ladder and enclosing a space large enough for a person to fit through.

In a water rescue apparatus as described above, a person who has fallen into the water makes his or her way to the rescue apparatus and climbs the safety ladder. Pleasure boats and the like moor alongside floating piers; however, the possibility that a pleasure boat and the like will come into contact with a rescue apparatus is kept to a minimum by way of providing the rescue apparatus at a location a specific distance away from any cleats used for mooring. Even if a pleasure boat or the like should come into contact with a rescue apparatus, however, the impact is cushioned by the fender member.

Also, the safety ladder is divided into an upper ladder and a lower ladder, and the lower ladder is designed so that it can be stowed in the upper ladder through a latching means. When not in use, the lower ladder is stowed in the upper ladder and located above the water line, and at the time of use the latching means is released so that the lower ladder is extended downward. A person who has fallen makes his or her way to the rescue apparatus, releases the latching means so as to allow the lower ladder to move down into the water, and puts his or her feet on the lower ladder and climbs out onto the deck of the floating pier or onto the transom step of a boat.

A similar safety ladder is disclosed in Japanese Utility Model Application Laid-Open (Kokai) H7-24697. The safety ladder disclosed in this publication is disposed on the outside of a vessel by placing a hook over the gunwale and is comprised of a stationary ladder and a sliding ladder. A landing space is provided on the sliding ladder at the bottom, and a rescue winch is provided for raising and lowering the sliding ladder. The safety ladder is normally stowed on board, and it is deployed to the outside of the vessel in the event of an accident.

[Patent Document 1] Japanese Patent Application Laid-Open (Kokai) 2000-144633

[Patent Document 2] Japanese Utility Model Application Laid-Open (Kokai) H7-24697

DISCLOSURE OF THE UTILITY MODEL

Problems which the Utility Model Attempts to Solve

Because the conventional floating pier safety ladders are constructed as described above, they have the drawbacks as follows: In the safety ladder disclosed in Japanese Patent Application Laid-Open (Kokai) 2000-144633, because the safety ladder is always attached to the side of the deck of a floating pier, even though it is provided at a location a specific distance away from the location where a cleat is attached, there is still the possibility that it could come into contact with a pleasure boat or the like, thus damaging the both. To avoid this possibility, a fender member(s) is provided so that it protrudes horizontally from the side of the deck and encloses a space around the safety ladder. However, this fender member itself is an extra member of the safety ladder; and because it protrudes horizontally from the side of the deck, avoiding contact with it is another source of concern in the operation of pleasure boats and so forth during docking and departure.

In addition, the safety ladder is divided into an upper ladder and a lower ladder, and the lower ladder is designed so that it can be stowed in the upper ladder through a latching means, so that a person who has made his or her way to the safety ladder would release the latching means and extend the lower ladder down into the water so as to climb out; however, there is such a danger that the lower ladder would suddenly drop down and extend once the latching means is released and that a person in the water who has made his or her way to that area and released the latching means would be hit by the lower ladder and sustain an injury. Furthermore, after use, a person needs to descend using the upper ladder, pull up the lower ladder, and operate a latching means at the bottom of the upper ladder to stow the lower ladder in the upper ladder; however, this work carries a high risk of the person falling into the water.

On the other hand, the safety ladder disclosed in Japanese Utility Model Application Laid-Open (Kokai) H7-24697 is, upon accident, installed at a location where the rescue activity is performed, and it is normally stowed away at a specific location; and when it is used for a floating pier, the place where it is stowed is not on the floating pier, but in a warehouse or the like on land. Therefore, it takes quite some time after an accident to go from the vicinity of the accident site to the place where the safety ladder is installed.

The present utility model is created in an effort to solve these problems, and it is an object thereof to provide a marine safety ladder that allows rescue to be performed within a short time after an accident has occurred without risk of mutual damage by contact with a pleasure boat or the like, without causing any additional concern in the operation of pleasure boats and so forth during docking and departure about avoiding contact, without the risk of injury to a person in the water who has made his or her way to the safety ladder, and without the risk of falling when the ladder is put away after use.

Means Used to Solve the Above-Mentioned Problems

The marine safety ladder according to the present utility model comprises:

a main ladder made up of beams and rungs provided at a plurality of locations spaced a suitable distance apart in the lengthwise direction of the beams;

guide rails of approximately the same length as the main ladder and disposed parallel to the beams of the main ladder;

top connecting members that connect and fix the top ends of the main ladder and the guide rails;

bottom connecting members that connect and fix the bottom ends of the main ladder and the guide rails;

a sliding member that is able to slide along the guide rails;

an auxiliary ladder that is extendable in the sliding direction from the top end of the sliding member;

sliding function members that are rotatably connected at one end thereof to the sliding member;

a bottom latch element capable of detachably engaging the bottom end of the main ladder or the members in the vicinity thereof;

sliding member latch elements connected to the sliding member and capable of detachably engaging the top end of the main ladder or the members in the vicinity thereof;

a top hinge member rotatably supporting the top connecting members;

a middle hinge member rotatably supporting the other ends of the sliding function members; and a bottom hinge member rotatably supporting the bottom latch element; and in this structure:

in the width direction of the underside of a deck of a floating pier or of the transom step of a boat, the top hinge member is connected and fixed to one end of the underside, the middle hinge member is connected and fixed to in the middle of the underside, and the bottom hinge member is connected and fixed to the other end of the underside;

the main ladder and the guide rails are rotatable about the top hinge member via the top connecting members; and in a state in which the bottom end of the main ladder, or the members in the vicinity thereof, is engaged by the bottom latch element, the sliding member is located at the bottom end of the guide rails, and all the constituting parts of the ladder are stowed within the width of the deck of the floating pier.

In the above structure, the top hinge member, the middle hinge member, and the bottom hinge member are supported by integral support members stowed within the width of the deck of the floating pier or the transom step of the boat.

Effect of the Utility Model

Because the safety ladder according to the present utility model is constructed as described above, it has the following effects: since the safety ladder is stowed within the width of the deck of a floating pier or within the width of the transom step of a boat, when it is not being used to rescue someone who has fallen in the water, the safety ladder is normally stowed under the deck and does not protrude from the side of the deck; as a result, there is no risk of mutual damage by contact with a pleasure boat or the like, and additional concern over avoiding such contact in the docking or departure of a pleasure boat or the like is prevented.

In addition, since the safety ladder according to the present utility model is normally stowed under the deck, it does not get in the way of ordinary use of a boat or a floating pier; and if it is installed and stowed at a plurality of suitable locations along a floating pier, it can be a marine safety ladder that can be used a short time after an accident occurs.

The marine safety ladder according to the present utility model is basically designed so as to be operated by a person who has fallen into the water. However, since it can also be operated by a person on the deck, a person in the water can be aided very rapidly.

Also, because the top hinge member, the middle hinge member, and the bottom hinge member are supported by integral support members, the work of mounting (connecting and fixing) the marine safety ladder is easy, and the middle hinge member can be positioned more accurately.

BEST MODE FOR CARRYING OUT THE UTILITY MODEL

Preferred embodiments of the marine safety ladder according to the present utility model will now be described in detail on a floating pier with reference to the accompanying drawings. The component with the reference numeral 10 in FIGS. 1, 2, 4, 5, and 6 is a floating pier safety ladder. The floating pier safety ladder 10 includes a main ladder 20, guide rails 30, a sliding member 40, an auxiliary ladder 50, and various other ladder constituting parts that will be described below.

The main ladder 20 is comprised of beams 21, which are two straight parts disposed in parallel, and rungs 22, which are provided at a plurality of locations spaced a suitable distance apart in the lengthwise direction of the beams 21 and bridging the beams 21. The main ladder 20 is not limited to the structure shown in the drawings, and the beams 21 can be U-shaped at the bottom ends, the top ends, or both ends, as with the beams 51 of the auxiliary ladder 50 described below. Also, for example, the main ladder 20 can be comprised of just one beam 21 and rungs 22 which are provided at the same locations or alternating locations on both sides of a single beam 21 and at a plurality of locations spaced a suitable distance apart in the lengthwise direction of the beam 21, and the rungs 22 can be bar shaped, stirrup shaped, ring shaped, etc.

As shown in FIGS. 2, 5, and 6, the guide rails 30 are straight parts of approximately the same length as the beams 21 of the main ladder 20. One guide rail 30 is disposed to each one of the two beams 21 on the same side of the main ladder 20, and these guide rails 30 are disposed in parallel and spaced a suitable distance apart. The top ends of the guide rails 30, as shown in FIGS. 1, 2, and 3, are connected and fixed to the top ends of the corresponding beams 21 by top connecting members 61, and the bottom ends of the guide rails 30 are connected and fixed to the bottom ends of the corresponding beams 21 by bottom connecting members 62. A top end latching rod member 74 is provided between the top connecting members 61 on both sides to latch sliding member latch elements 65 (described below), and a bottom end latching rod member 73 is provided between the bottom connecting members 62 to latch a bottom latch element 64 (described below). One end of a rope R is fixed to the bottom latch element 64, and the other end of the rope R is inserted in a rope ring RR fixed near the top connecting members 61, so that the rope R is allowed to hang down near the sea level SL and a person who has fallen into the water can pull the rope R and release the engagement of the bottom latch element 64 from the bottom end latching rod member 73. The cross sectional shape of the guide rails 30 is not limited to the rectangular bar shape or tubular shape shown in FIGS. 5 and 6, and it can instead be circular, peaked (L-shaped), groove shaped (open box section), H-shaped, or the like. Furthermore, only one guide rail 30 can be disposed in the middle portion of the two beams 21. Also, the top end latching rod member 74 and bottom end latching rod member 73 can be omitted, so that the sliding member latch elements 65 and the bottom latch element 64 are respectively engaged with the rungs 22 of the main ladder 20.

As shown in FIGS. 2, 4, and 6, the sliding member 40 is disposes so that it can slide back and forth in the lengthwise direction of the guide rails 30 along the guide rails 30. More specifically, two sliding plates 41, which are wide enough to bridge the two guide rails 30, and two guide members 42 are provided so that the two sliding plates 41 are disposed to sandwich the two guide rails 30 from both sides at the same time with a slidable gap in between, and the two guide members 42 are disposed on the inner side of the two guide rails 30 and between the two sliding plates 41 and with a slidable gap in between. In case that only one guide rail 30 is provided, then the sliding member 40 is provided so that it is slidably envelop the single guide rail 30.

As shown in FIGS. 2 and 3, sliding function members 63, which are slender members in the form of plates, bars, or the like, are rotatably connected at one end of each of them to the back side of the sliding member 40, that is, on the front side of the sliding plate 41 which is installed on the opposite side from the main ladder 20. As shown in FIGS. 3 and 4, the root ends of the sliding member latch elements 65, which have latching prongs formed at the distal ends, are rotatably connected to this same back side of the sliding member 40 by a hinge member 72, with the distal ends of the sliding member latch elements 65 facing the top ends of the guide rails 30 and the main ladder 20.

The auxiliary ladder 50 is comprised of a tall, inverted U-shaped beam 51 and rungs 52 that are provided spanning the beams 51 at a plurality of locations spaced a suitable distance apart in the lengthwise direction of the beams 51. The auxiliary ladder 50 is designed such that the bottom of its U-shape extends toward the top ends of the guide rails 30 and the main ladder 20 and the intermediate portions of the U-shape are disposed (that is, extended) so as to be parallel to the guide rails 30 and the main ladder 20, and the open ends on both sides of the U-shape's distal ends are connected and fixed to the sliding member 40. Also, as can be seen from FIG. 4, when the sliding member 40 is located at the lowermost ends of the guide rails 30, the upper distal ends of the auxiliary ladder 50 is stowed within the top ends of the guide rails 30 and the main ladder 20. Furthermore, as shown in FIGS. 1, 4, and 5, the width of the beams 51 (that is, the auxiliary ladder 50) is less than the inside spacing between the two beams 21 of the main ladder 20, so that the auxiliary ladder 50 can be stowed between the separated guide rails 30 and main ladder 20 and between the two beams 21 of the main ladder 20.

The auxiliary ladder 50 is not limited to having U-shaped beams 51, and just as with the main ladder 20, it can be comprised of two beams 51 and a plurality of rungs 52, and it can be comprised of a single beam 51 and rungs 52 which are provided at the same locations or alternating locations on both sides of the single beam 51 and at a plurality of locations spaced a suitable distance apart in the lengthwise direction of the beam 51. Furthermore, the rungs 52 can be omitted so that the auxiliary ladder 50 is comprised only of a bar-shaped or U-shaped beam 51.

In FIGS. 1 and 2, the reference numeral 66 refers to support members, which are slender members approximately the same length as the guide rails 30 and the main ladder 20 and have a cross section that is peaked (L-shaped), T-shaped, groove shaped, or the like. The support members 66 are disposed on the opposite side of the main ladder 20 from the guide rails 30, and they are disposed along the two guide rails 30 (or one support member is provided if there is only one guide rail).

The top connecting members 61 are rotatably connected at one end of each of them (that is, at the ends on the opposite side from the main ladder 20 side) to the top ends of the support members 66 (the top end side of the guide rails 30 and the main ladder 20) by the top hinge member 67. The sliding function members 63 are rotatably connected at other end of each of them (one end of each of them being connected to the sliding member 40 as described above) to the middle parts on the top end sides of the support members 66 by the middle hinge member 68. The root end of the bottom latch element 64, which has a latching prong formed at its distal end, is rotatably connected to the bottom end of the support members 66 (the bottom end side of the guide rails 30 and the main ladder 20) by the bottom hinge member 69. The respective support members 66 are not limited to being an integral single member as shown in FIGS. 2 and 3, and they can instead be divided into portions of the respective hinge members 67, 68 and 69; and further, the portion of the top hinge member 67 or the portion of the bottom hinge member 69 can be separated and divided in two.

As shown in FIG. 3, the above-described parts constituting the floating pier safety ladder 10 are constructed so that in a stowed state thereof, in which the sliding member 40 is disposed at the bottom end of the guide rails 30 and the latching prong at the distal end of the bottom latch element 64 is engaged with the bottom end latching rod member 73, all of the constituting parts are fitted within the width of the deck 2 of the floating pier 1, that is, within the length perpendicular to the passage direction of the deck 2.

The floating pier safety ladder 10 constructed as described above is mounted and operated as follows. As shown in FIGS. 1, 2, and 3, when the floating pier safety ladder 10 is in a stowed state under the deck 2 between floats 3 disposed at suitable intervals along the floating pier 1, the floating pier safety ladder 10 is disposed in the width direction of the deck 2 (see FIG. 2, perpendicular to the passage direction) with the support members 66 facing up, and the support members 66 are mounted and fixed to the underside of the deck 2 so that the floating pier safety ladder 10 does not protrude from either side of the deck 2.

When a person who fell in the water is rescued, etc., the floating pier safety ladder 10 mounted to the floating pier 1 is operated and used for rescuing as shown in FIG. 7. When not being used, the floating pier safety ladder 10 is stowed under the deck 2 so as not to protrude from the sides of the deck 2 as shown in (1) of FIG. 7.

When the ladder is to be used, as shown in (2) of FIG. 7, the bottom latch element 64 is rotated about the bottom hinge member 69 to move its distal end prong away from the bottom end latching rod member 73. When the bottom end latching rod member 73 is pulled up at this point, the bottom latch element 64 can be easily taken off. As a result, the main ladder 20, the guide rails 30, the sliding member 40, the auxiliary ladder 50, and the accessory parts thereof are rotated under their own weight around the top hinge member 67 via the top connecting members 61, and the bottom end side hangs down. At the same time, by the hinged sliding function members 63, one end of each of them being rotatably connected via a hinge member 71 to the sliding member 40 and the other end of each of them being connected via the middle hinge member 68 to the support members 66, the sliding member 40 is slid along the guide rails 30 from the bottom end toward the end, so that the distal end of the auxiliary ladder 50 protrudes from the top ends of the guide rails 30 and the main ladder 20.

A state rotated by approximately 45 degrees is shown in (2) of FIG. 7, by approximately 60 degrees in (3), and by approximately 90 degrees in (4), respectively. During this process, the sliding member 40 moves farther along the guide rails 30 toward the top end, and the distal end of the auxiliary ladder 50 protrudes farther from the top end of the floating pier safety ladder 10, ending up to protrude by the required length and rotated by 90 degrees. Because one end of each of the top connecting members 61, that is, the end on the opposite side from the main ladder 20, is rotatably connected to the top ends of the support members 66, after this 90 degree rotation, the guide rails 30 and the main ladder 20 are put in a vertically hanging-down position on the outside of the side face of the deck 2.

During the above-described rotation, the middle hinge member 68 that rotatably supports the other ends of the sliding function members 63 is located in the middle point on the top end side of the support members 66, the sliding function members 63 can make a rotation of 90 degrees and even beyond 90 degrees as shown in (5) of FIG. 7. The position of the middle hinge member 68 in the middle point on the top end side of the support members 66, in other words, the length of the sliding function members 63 from the middle hinge member 68 to the hinge member 71 on the back side of the sliding member 40, is determined by taking into account the conditions such as the protruding length of the distal end of the auxiliary ladder 50 from the top end of the floating pier safety ladder 10, and the easiness of the sliding motion of the sliding member 40.

In the state (5) of FIG. 7, the protruding auxiliary ladder 50, for example, is rotated further from the state of completion of the approximate 90-degree rotation shown in (4). As a result, the latching prongs of the sliding member latch elements 65 rotatably connected to the back of the sliding member 40 go past the top end latching rod member 74 provided to the top connecting members 61. After this, the auxiliary ladder 50 is rotated back to its original position of (4) in FIG. 7; as a result, the latching prongs of the sliding member latch elements 65 engage the top end latching rod member 74, and as shown in (6) of FIG. 7, the sliding member 40 and the auxiliary ladder 50 are positionally held so as to be integrated with the guide rails 30 and the main ladder 20 via the top end latching rod member 74 and the sliding member latch elements 65; and thus the floating pier safety ladder 10 is ready to be used for rescuing in this state. Since the main ladder 20 and the auxiliary ladder 50 are in a state that they are prevented, by the sliding function members 63 functioning as a supporting member, from rotating around the top hinge member 67 and are hang down vertically on the outside of the side face of the deck 2 as described above. As a result, no back and forth shaking occurs during the climbing up and down actions of a rescuer and/or rescuee on the main ladder 20 and auxiliary ladder 50, and it is possible to move between the deck 2 and the main ladder 20 and auxiliary ladder 50.

When the ladder is stowed after use, the operation is reversed from that described above for the use; in other words, the operation progresses from (6) to (1) in FIG. 7. More specifically, from the usage state in (6), the ladder is rotated past 90 degrees in (5) so as to disengage the sliding member latch elements 65 from the top end latching rod member 74 and to release the engaged state. Next, a rope or the like is tied to the bottom end of the main ladder 20 or guide rails 30, and the rope is pulled from the opposite side from the deck 2, that is, the bottom end side in the stowed state of the floating pier safety ladder 10, and the procedure is carried out from (4) to (1), rotating the ladder about the top hinge member 67 via the top connecting members 61, and pulling up the bottom end. When the ladder has been pulled up all the way, the distal end prong of the bottom latch element 64 is engaged with to the bottom end latching rod member 73. During this process, the sliding member 40 is, while being held by the sliding function members 63, moved along the guide rails 30 to the bottom end of the guide rails 30, and the top end of the auxiliary ladder 50 is moved below the top end of the main ladder 20 and guide rails 30. As a result, as shown in (1) or in FIG. 3, the floating pier safety ladder 10 is stowed under the deck 2 in a state that it does not protrude at its either end from both sides of the deck.

The above-described marine safety ladder can be provided to a transom step of a boat such as a pleasure boat, rather than to the deck of a floating pier described above. An example of mounting the safety ladder 10 to a transom step 2' of a boat 1' is shown in FIG. 8. Since the structure of the safety ladder is the same as that described above and thus will not be described here again.

Figure 1:
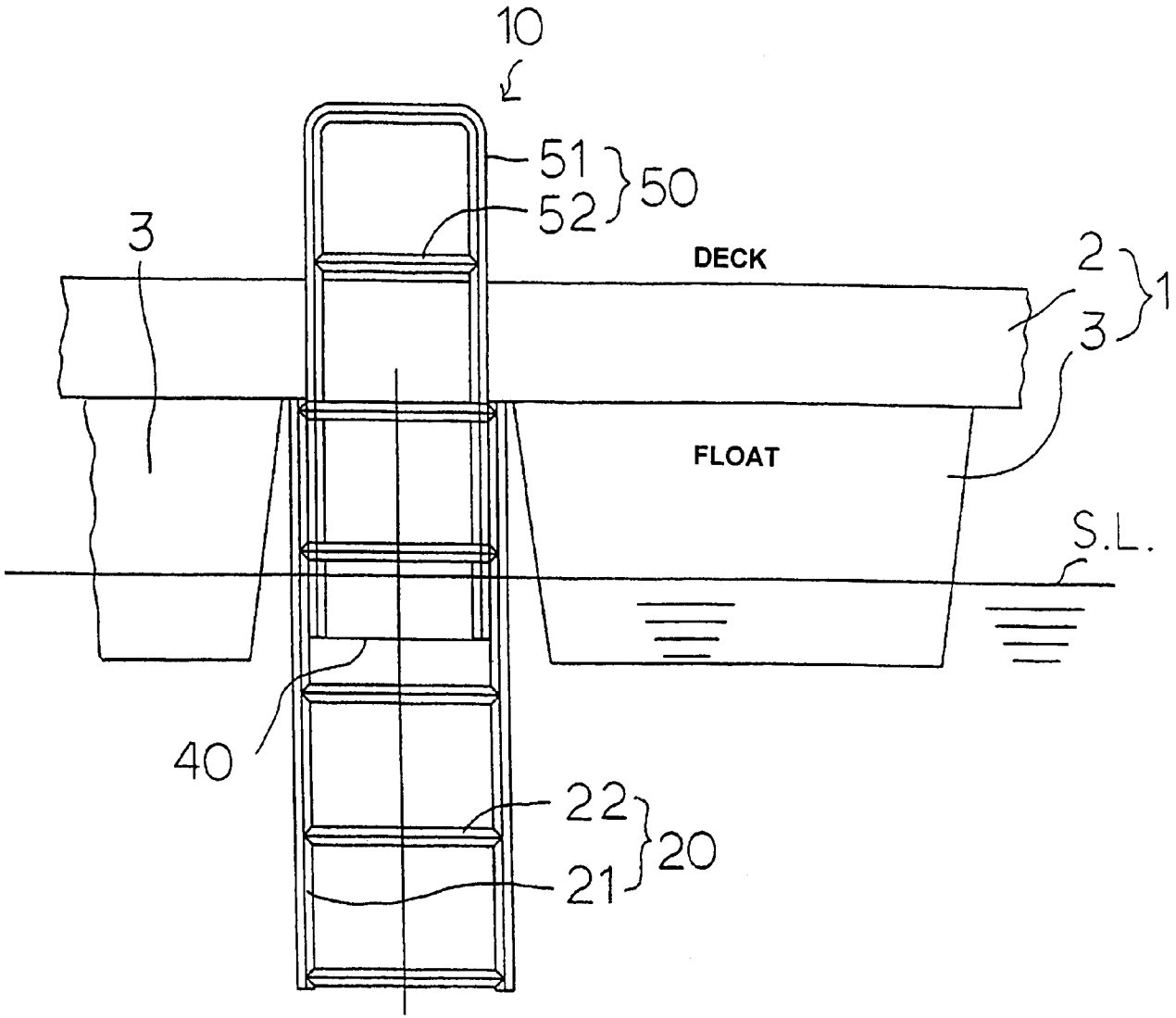
FIG. 1 is a front view of a usage state of the marine safety ladder, provided to a floating pier, according to the present utility model.
Figure 2:
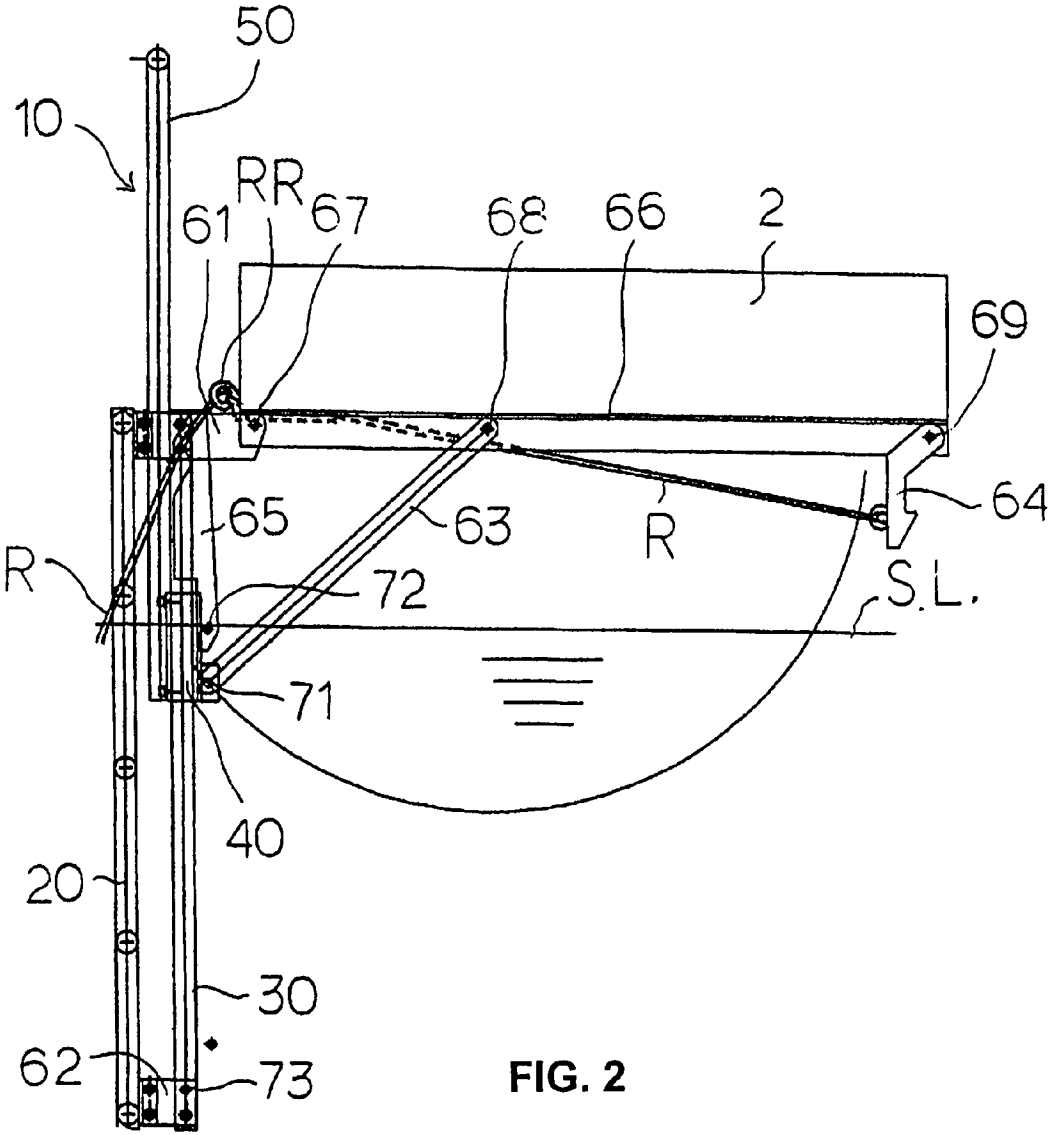
FIG. 2 is a right side view of FIG. 1.
Figure 3:
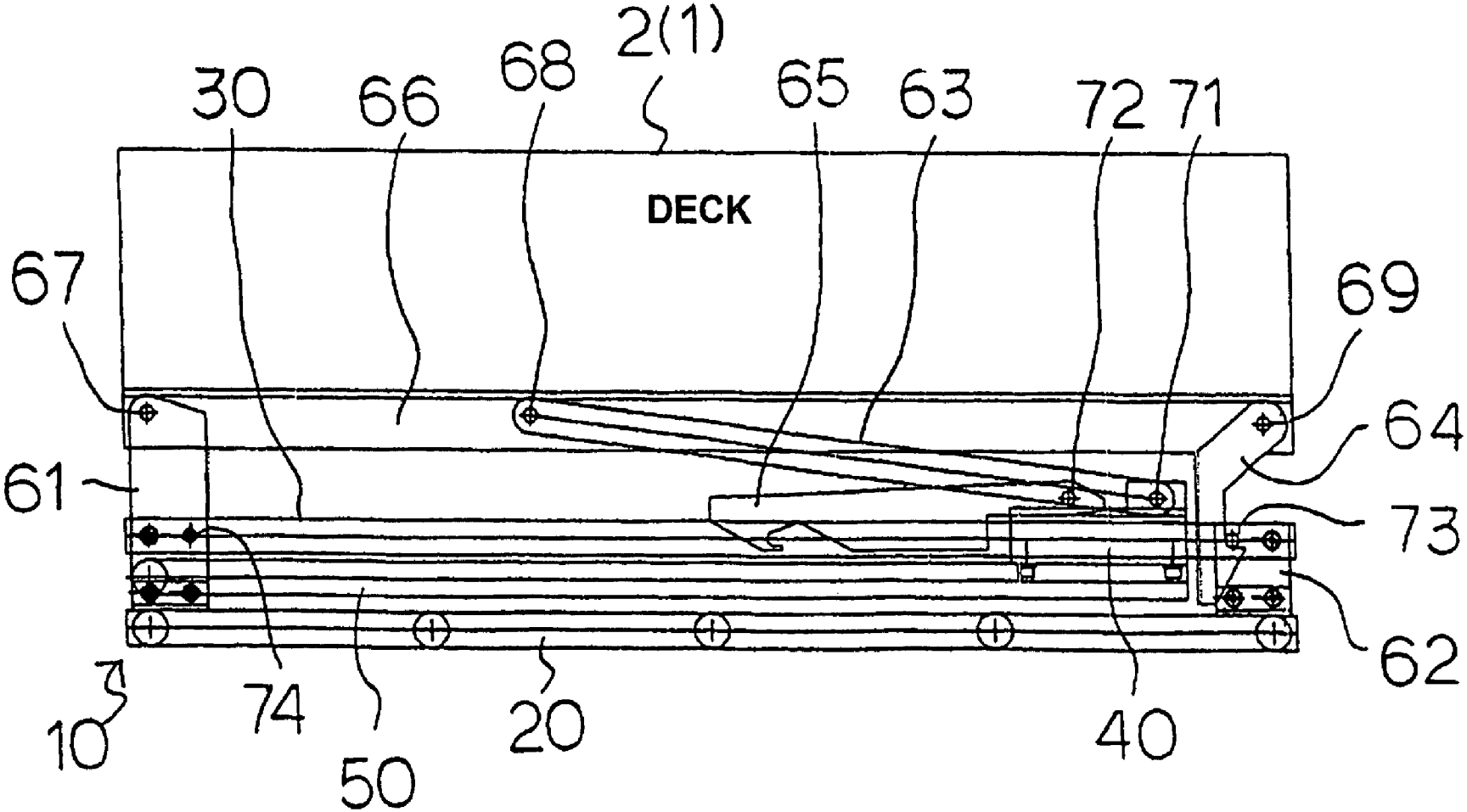
FIG. 3 is a right side view of the stowed state of the marine safety ladder, provided to a floating pier, according to the present utility model.
Figure 4:
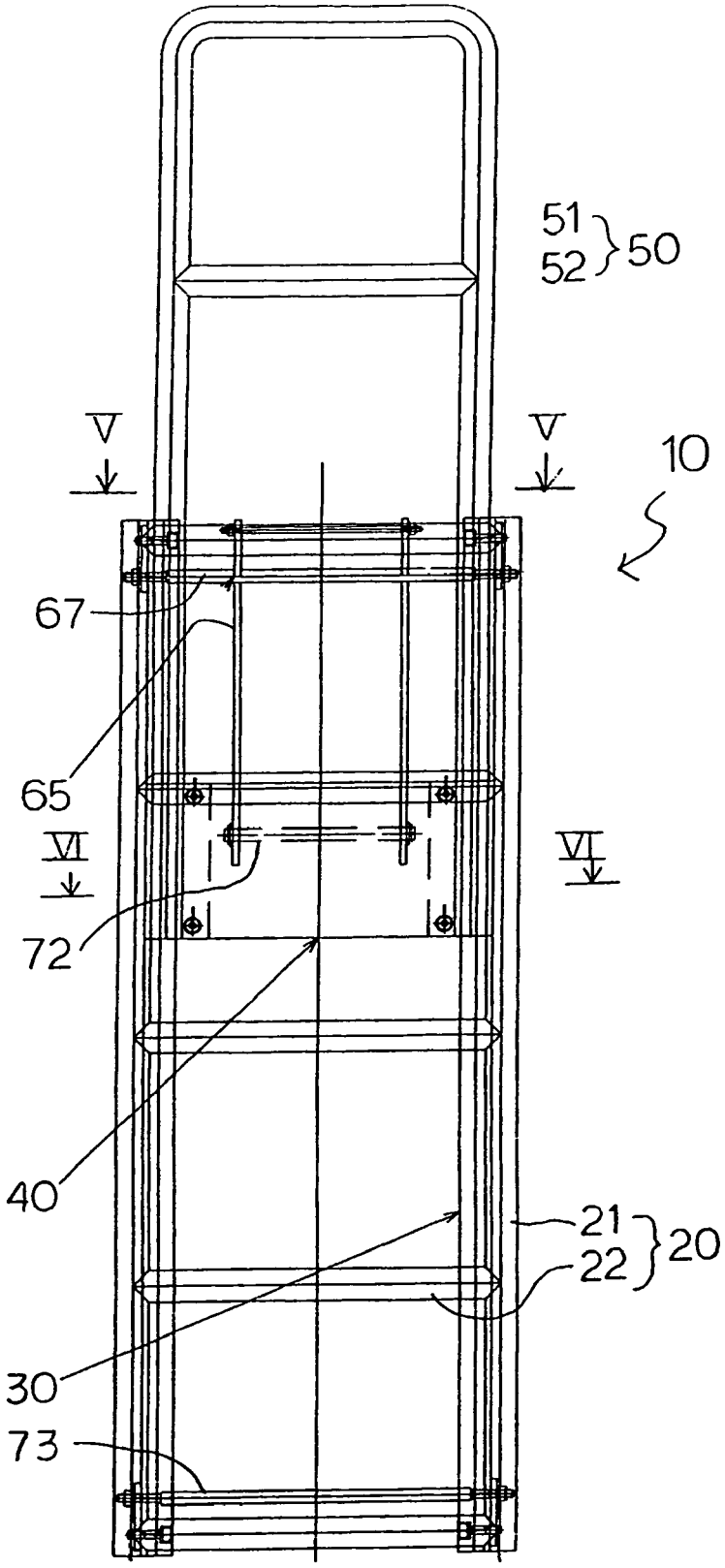
FIG. 4 is a front view of a usage state of the marine safety ladder according to the present utility model.
Figure 5:
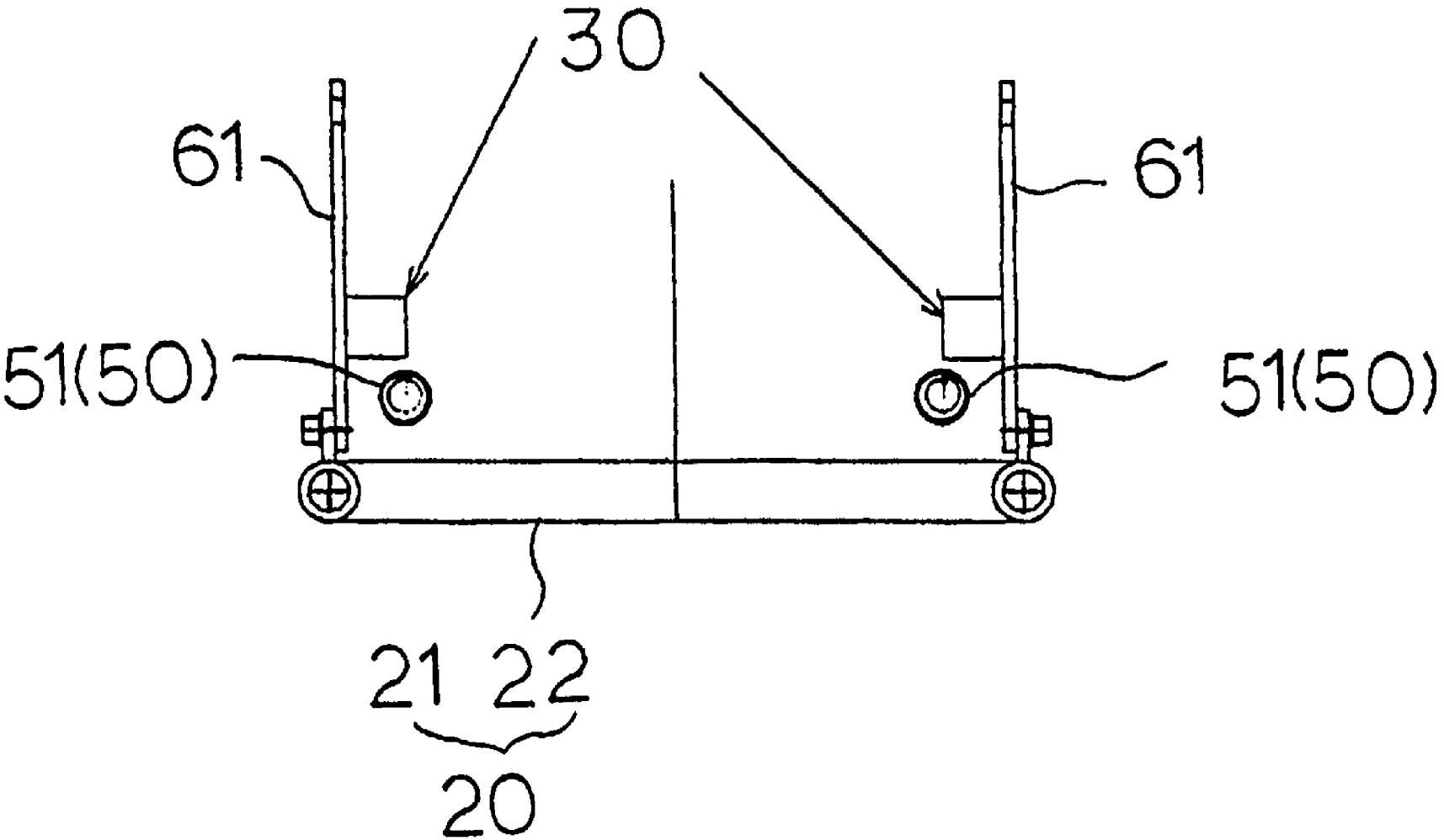
FIG. 5 is a cross sectional view taken along the line V-V in FIG. 4.
Figure 6:
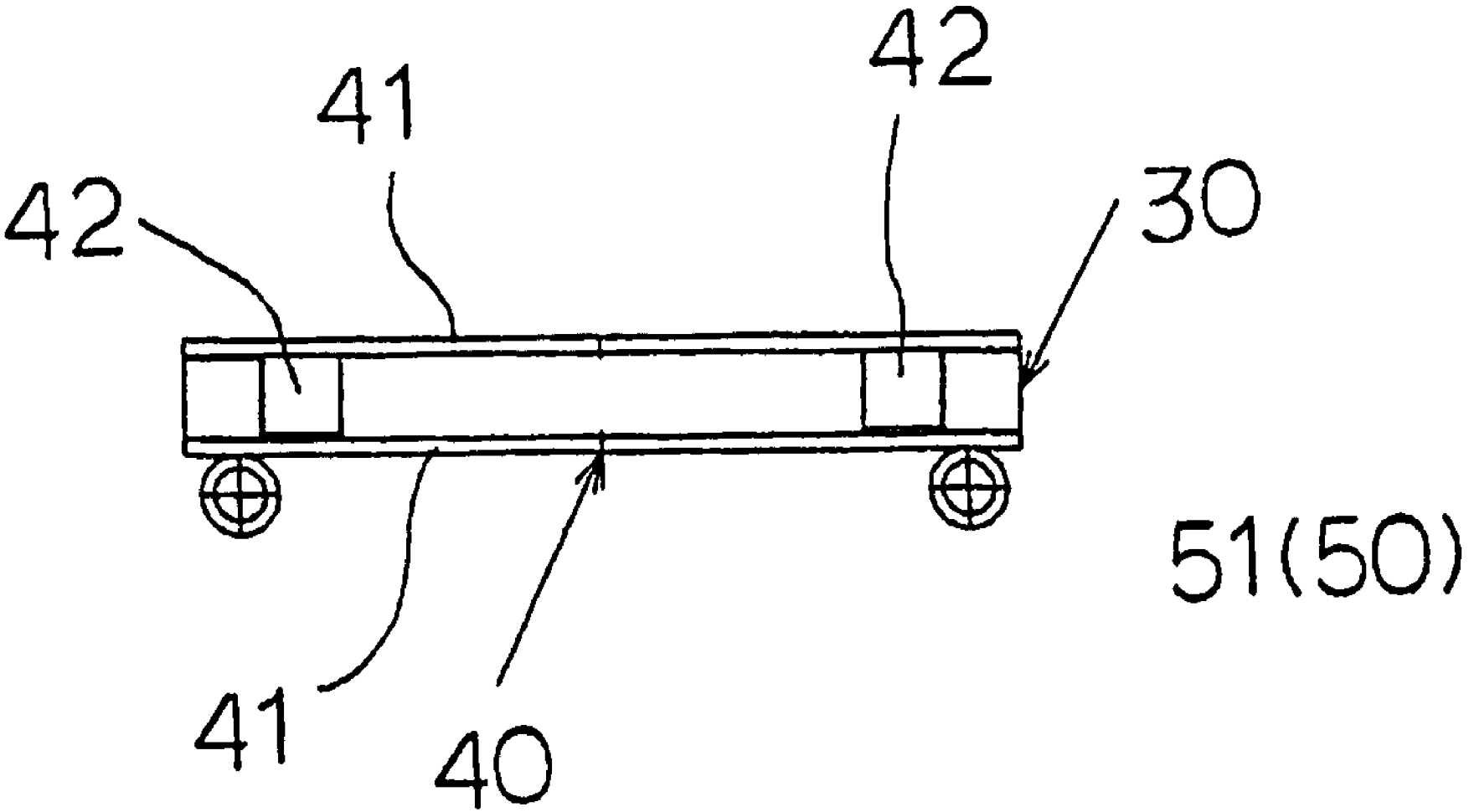
FIG. 6 is a cross sectional view taken along the line VI-VI in FIG. 4.
Figure 7:
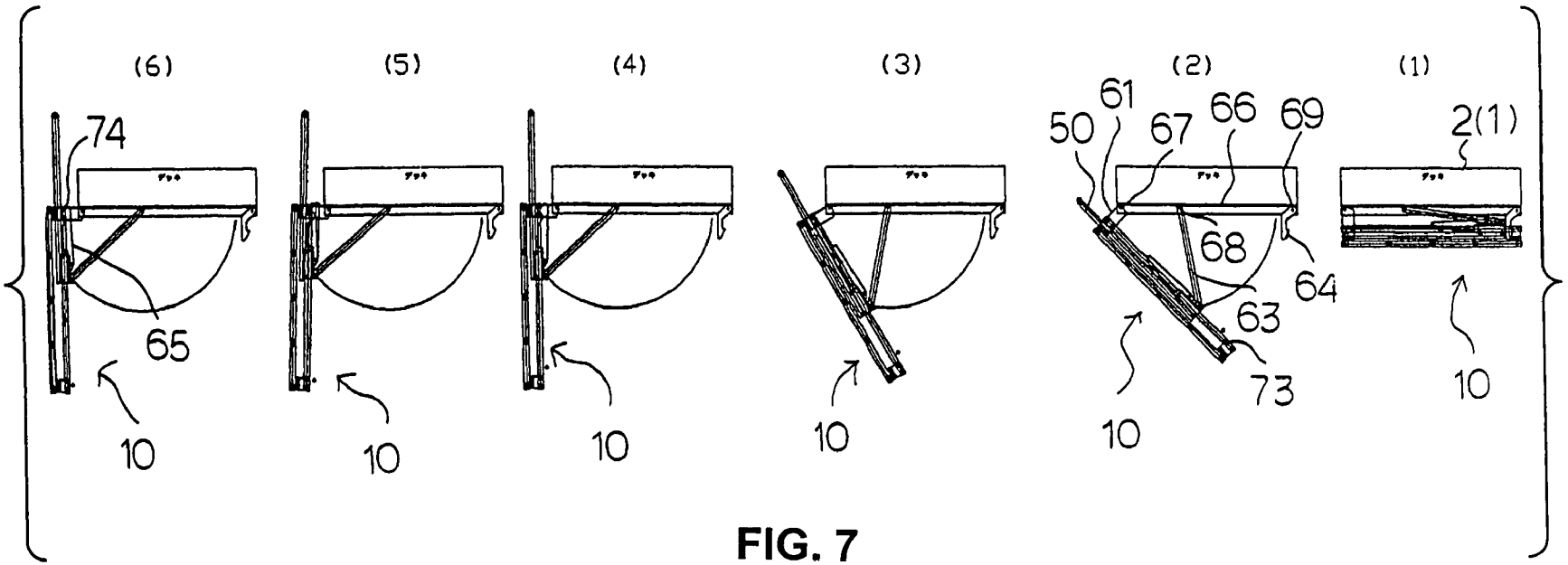
FIG. 7 shows a working diagram illustrating the changes from the stowed state to the usage state of the marine safety ladder according to the present utility model.
Figure 8:
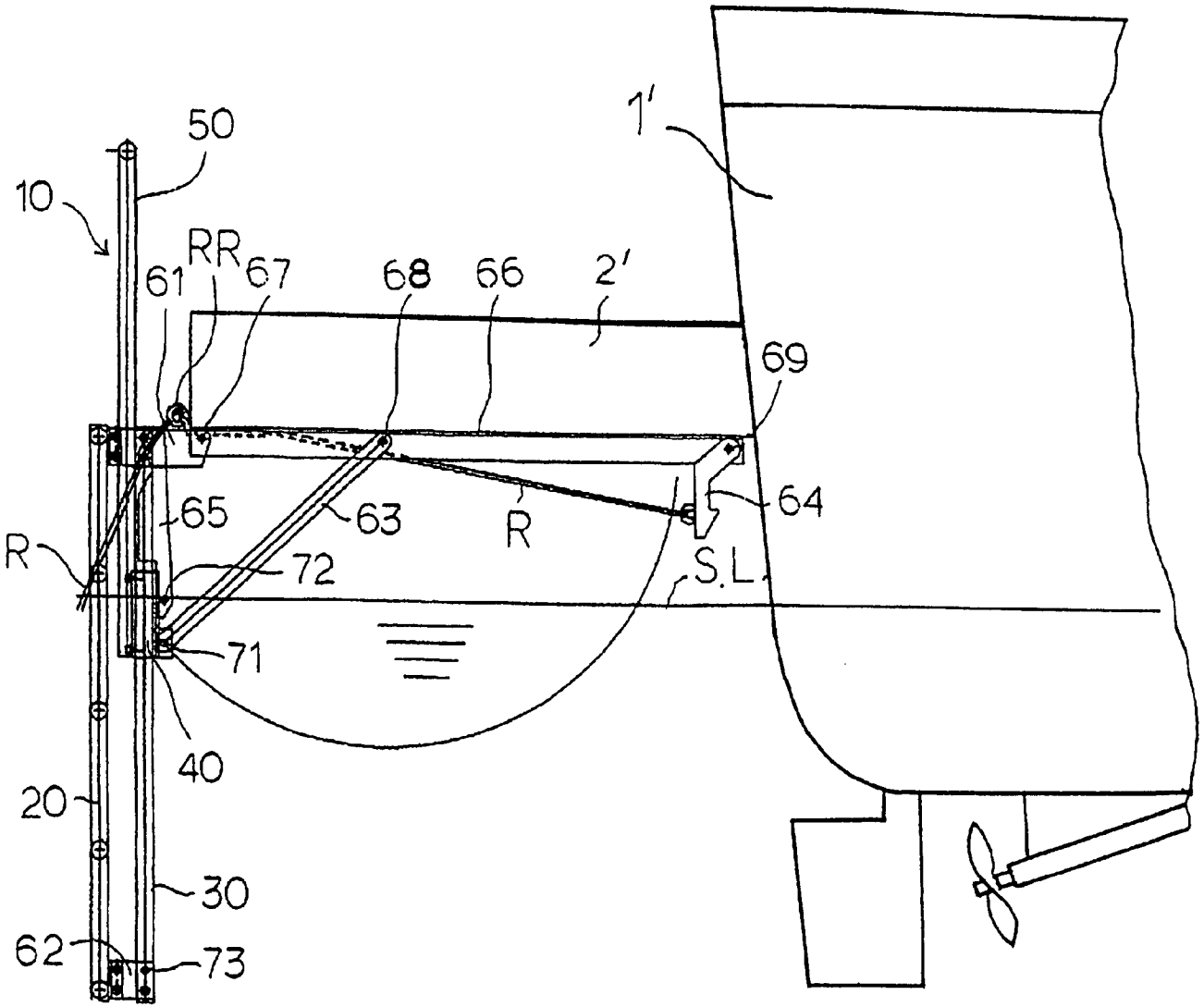
FIG. 8 is a partially cut-away right side view of a state in which the marine safety ladder according to the present utility model is mounted to the transom step of a boat, which is another embodiment of the present utility model.

The invention claimed is:

1. A marine safety ladder comprising:

a main ladder made up of beams and rungs provided at a plurality of locations spaced a suitable distance apart in a lengthwise direction of the beams;

guide rails of approximately the same length as the main ladder and disposed parallel to the beams of the main ladder;

top connecting members connecting and fixing respective top ends of the main ladder and the guide rails;

bottom connecting members that connecting and fixing the respective bottom ends of the main ladder and the guide rails;

a sliding member that is slidable along the guide rails;

an auxiliary ladder extensable in the sliding direction from the top end of the sliding member;

sliding function members respectively, rotatably connected at one end thereof to the sliding member;

a bottom latch element capable of detachably engaging the bottom end of the main ladder or the members in the vicinity thereof;

sliding member latch elements connected to the sliding member and capable of detachably engaging the top end of the main ladder or the members in a vicinity thereof;

a top hinge member rotatably supporting top connecting members;

a middle hinge member rotatably supporting the other ends of the sliding function members; and a bottom hinge member rotatably supporting the bottom latch element; wherein the top hinge member is connected and fixed to one end of an underside of a deck of a floating pier or of a transom step of a boat in a width direction thereof, the middle hinge member at a middle thereof, and the bottom hinge member to an other end thereof, and the main ladder and the guide rails are rotatable about the top hinge member via the top connecting members, and with the bottom latch element being engaged with the bottom end of the main ladder or the members in the vicinity thereof, the sliding member is located at bottom ends of the guide rails, and all parts of the ladder are stowed within the width of the deck of the floating pier.

2. The marine safety ladder according to claim 1, wherein the top hinge member, the middle hinge member, and the bottom hinge member are supported by integral support members stowed within the width of the deck of the floating pier or the transom step of the boat.

* * * * *